US008943750B2

(12) United States Patent
Twork, Jr.

(10) Patent No.: US 8,943,750 B2
(45) Date of Patent: Feb. 3, 2015

(54) VEHICLE WINDOW ASSEMBLY WITH LIFT PLATE

(75) Inventor: Michael J. Twork, Jr., White Lake, MI (US)

(73) Assignee: Faurecia Interior Systems, Inc., Auburn Hills, MI (US)

( * ) Notice: Subject to any disclaimer, the term of this patent is extended or adjusted under 35 U.S.C. 154(b) by 0 days.

(21) Appl. No.: 13/530,491

(22) Filed: Jun. 22, 2012

(65) Prior Publication Data

US 2013/0340347 A1 Dec. 26, 2013

(51) Int. Cl.
*E05F 11/48* (2006.01)

(52) U.S. Cl.
USPC ..... 49/352; 49/375

(58) Field of Classification Search
USPC ..... 49/348, 349, 352, 372, 374, 375; 4/612, 4/613, 614
See application file for complete search history.

(56) References Cited

U.S. PATENT DOCUMENTS

| | | | | | |
|---|---|---|---|---|---|
| 4,503,639 | A | * | 3/1985 | Rossie et al. | 49/374 |
| 4,644,695 | A | * | 2/1987 | Shiraishi et al. | 49/352 |
| 4,848,032 | A | * | 7/1989 | Ballor et al. | 49/350 |
| 4,987,699 | A | * | 1/1991 | Gold | 49/375 |
| 5,363,595 | A | * | 11/1994 | Wirsing | 49/375 |
| 5,392,563 | A | | 2/1995 | Cardine | |
| 5,502,926 | A | * | 4/1996 | Grace et al. | 49/375 |
| 5,546,704 | A | * | 8/1996 | Maruoka | 49/375 |
| 5,551,197 | A | | 9/1996 | Repp et al. | |
| 5,622,005 | A | * | 4/1997 | Ochenski et al. | 49/375 |
| 5,765,310 | A | * | 6/1998 | Gold | 49/375 |
| 5,778,599 | A | * | 7/1998 | Saito | 49/375 |
| 5,966,872 | A | * | 10/1999 | Wasek et al. | 49/375 |
| 6,152,636 | A | * | 11/2000 | Nass | 403/13 |
| 6,397,524 | B1 | * | 6/2002 | Sakaguchi et al. | 49/375 |
| 6,453,617 | B1 | * | 9/2002 | Klippert et al. | 49/375 |
| 6,460,296 | B1 | * | 10/2002 | Arquevaux | 49/375 |
| 7,584,573 | B2 | * | 9/2009 | Yoshii et al. | 49/375 |
| 7,596,908 | B2 | * | 10/2009 | Rothe et al. | 49/374 |
| 2002/0073622 | A1 | * | 6/2002 | Davis | 49/349 |
| 2007/0180773 | A1 | * | 8/2007 | Fortin et al. | 49/352 |

FOREIGN PATENT DOCUMENTS

| | | | | |
|---|---|---|---|---|
| EP | 597764 | A1 * | 5/1994 | E05F 11/38 |
| FR | 2895765 | | 7/2007 | |
| FR | 2944310 | | 10/2010 | |
| KR | 20030093391 | | 12/2003 | |
| WO | WO2009069899 | | 6/2009 | |

* cited by examiner

*Primary Examiner* — Jerry Redman
(74) *Attorney, Agent, or Firm* — Reising Ethington P.C.

(57) ABSTRACT

A window assembly for a vehicle includes a glass assembly, a lift plate, and an actuator mechanism coupled with the glass assembly by the lift plate. The glass assembly has an aperture formed therethrough, and the actuator mechanism moves the glass assembly by applying a load at the aperture. A fastener may extend at least partially through the aperture from a shoulder at one side of the glass sheet to an end at an opposite side of the glass sheet. The window assembly may also include a coupling layer, such as an adhesive layer, between the fastener and the glass sheet. The window assembly can be constructed in a relatively compact configuration to save space within a vehicle door or panel.

20 Claims, 3 Drawing Sheets

VEHICLE WINDOW ASSEMBLY WITH LIFT PLATE

TECHNICAL FIELD

The present disclosure relates to vehicle window assemblies, and more specifically to structures for moving vehicle windows.

BACKGROUND

Automotive vehicles commonly have one or more windows which may be opened and closed. The windows may be positioned within vehicle doors or within fixed panels. Vehicle windows may be manually moved by a vehicle occupant, or they may be power windows that are moved by electric power. Various structures have been devised to support vehicle windows during such movement.

U.S. Pat. No. 5,392,563 to Cardine describes a clamping device for a vehicle winder mechanism. The device has a first arm and a second arm arranged in an X-configuration connected to a shaped rail which supports the window. The first arm is connected to a rotational device to drive the window up and down while the second arm is connected to the door structure creating a pivot point against which the window may be raised. As with some other devices used to move vehicle windows, the Cardine device supports the window along the bottom edge.

SUMMARY

In accordance with one embodiment, there is provided a glass assembly for use in a vehicle. The glass assembly includes a glass sheet having an aperture formed therethrough and a fastener coupled to the glass sheet at the aperture. The fastener has a shoulder at one side of the glass sheet and a body portion extending at least partially through the aperture to an end that is accessible from an opposite side of the glass sheet for attachment of a lift plate to the glass assembly. The glass assembly also includes a coupling layer between the fastener and the glass sheet.

In another embodiment, the coupling layer is an adhesive layer.

In another embodiment, the fastener includes internal threads for attachment of the lift plate to the glass assembly using an externally threaded fastener.

In another embodiment, there is provided a window assembly including the glass assembly, a lift plate attached to the glass assembly at said opposite side of the glass sheet, and an actuator mechanism attached to the lift plate for moving the glass assembly such that a load is applied at the aperture when the actuator mechanism moves the glass assembly and the coupling layer bears at least a portion of the load.

In accordance with another embodiment, there is provided a window assembly for use in a vehicle. The window assembly includes a glass assembly having a glass sheet with an aperture formed therethrough and a first fastener bonded to one side of the glass sheet at the aperture. The window assembly also includes a lift plate located at an opposite side of the glass sheet and attached to the first fastener with a second fastener. A portion of at least one of the fasteners extends through the aperture. The window assembly also includes an actuator mechanism attached to the lift plate for moving the glass assembly.

In another embodiment, the lift plate is free to rotate at least partly about at least one of the fasteners.

In another embodiment, the first fastener includes a shoulder at said one side of the glass sheet and a body portion extending at least partially through the aperture.

In another embodiment, the first fastener extends at least partially through the lift plate and includes a shoulder in contact with the lift plate.

In another embodiment, the window assembly includes an adhesive layer that bonds the first fastener to the glass sheet and extends at least partially through the aperture.

In another embodiment, the actuator mechanism includes one or more cables attached to the lift plate such that at least one cable is offset from the glass sheet by 5 mm or less.

In accordance with another embodiment, there is provided a method of making a window assembly for use in a vehicle. The method includes the steps of: (a) coupling a first fastener at one side of a glass sheet at an aperture formed through the glass sheet; and (b) attaching a lift plate at an opposite side of the glass sheet using a second fastener such that a portion of at least one of the fasteners extends through the aperture.

In another embodiment, the method includes applying an adhesive layer to at least one of the first fastener or the glass sheet.

In another embodiment, the method includes inserting a body portion of the first fastener through the aperture so that an end of the first fastener at said opposite side of the glass sheet extends beyond the plane of said opposite side of the glass sheet.

In another embodiment, the lift plate is coupled to an actuator mechanism such that movement of the actuator mechanism applies a load at an edge of the aperture.

In another embodiment, the method includes coupling the actuator mechanism to the glass sheet only via the lift plate such that substantially all lifting force supplied by the actuator mechanism is imparted to the glass sheet via the edge of the aperture.

In another embodiment, the method includes attaching the lift plate to the first fastener so that there is substantially no clamp load applied to the glass sheet between the first fastener and the lift plate.

All elements of the aforementioned embodiments may be used singly or in combination with any other of the elements without departing from the scope of this disclosure.

BRIEF DESCRIPTION OF THE DRAWINGS

One or more embodiments will hereinafter be described in conjunction with the appended drawings, wherein like designations denote like elements, and wherein.

DETAILED DESCRIPTION OF THE ILLUSTRATED EMBODIMENT(S)

Described and shown herein are examples of window assemblies for use in vehicles. The window assemblies include movable glass assemblies and may be supported at one or more apertures formed through the glass. The disclosed structures can reduce or eliminate the need for bulky structures that are typically necessary to support the glass at the bottom edge, thereby reducing the size of the packaging envelope and reliance on complex structures. For example, one or more fasteners may be used to support the glass at an aperture edge with the bottom edge of the glass unsupported, thus freeing up valuable packaging space in a vehicle door or panel. These structures can be configured with a slim profile as well.

Figure 1:
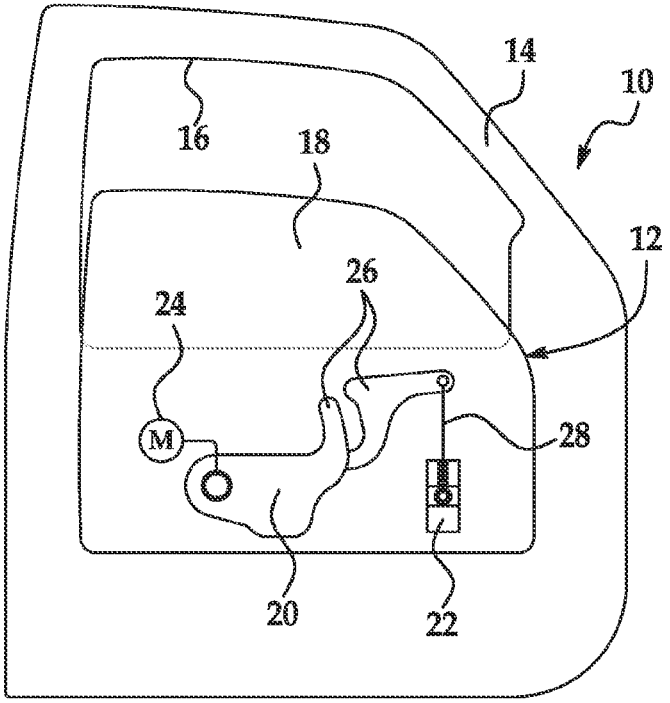
FIG. 1 is a cutaway view of a vehicle door, including a window assembly according to one embodiment.

FIG. 1 is a cutaway view of a vehicle door 10 including a window assembly 12 according to one embodiment. The door 10 includes a frame 14 with a window opening 16 formed therein. The illustrated window assembly 12 includes a glass assembly 18, an actuator mechanism 20 arranged to move the glass assembly 18 within the door frame, and a lift plate 22 that couples the actuator mechanism 20 with the glass assembly 18. The door 10 has a shell construction with spaced apart vertical panels. The illustrated components of the actuator mechanism 20 and lift plate 22 are generally hidden from view in a hollow area between the spaced panels and beneath the window opening 16 when assembled and during use.

As used herein, an actuator mechanism is a mechanism including one or more components arranged to move the glass assembly 18 in response to a user input. The particular actuator mechanism 20 shown in FIG. 1 includes an electric motor 24 that moves the glass assembly 18 up and down via one or more levers 26 and a cable 28. The motor 24 may be activated by a switch inside the vehicle, for example. In other embodiments, the actuator mechanism may be manual and can include a knob or crank operable by the user. The embodiment of FIG. 1 includes a single lift plate 22 that moves up to raise the glass assembly 18 toward a closed position and moves down to lower the glass assembly 18 toward an open position, aided by gravity.

Figure 2:
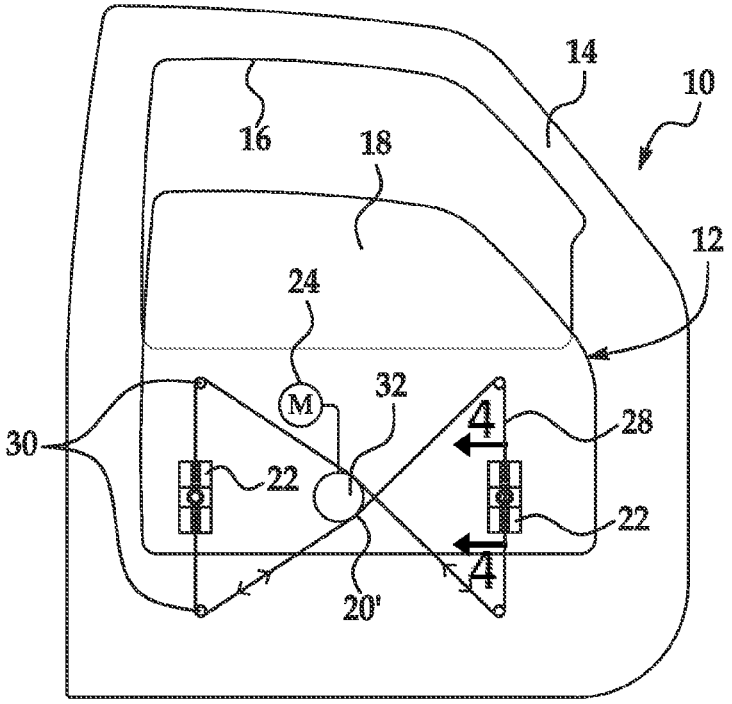
FIG. 2 is a cutaway view of a vehicle door, including a window assembly according to another embodiment.

FIG. 2 illustrates the vehicle door 10 with a different actuator mechanism 20' including a number of cables 28 and pulleys 30 arranged together with motor 24 and gear 32 to raise and lower the glass assembly 18. In this example, the actuator mechanism 20' is coupled to the glass assembly 18 by lift plates 22 at two locations. Each of the particular lift plates 22 shown in FIG. 2 is attached to a cable 28 of the actuator mechanism 20' at opposite ends of the plates so that the mechanism 20' can apply forces in both up and down directions to the glass assembly 18. Skilled artisans will appreciate that the actuator mechanism may include any number and arrangement of levers, cables, pulleys, motors, or other components arranged to move the glass assembly up and down, back and forth, or in and out with respect to a vehicle door or panel.

Figure 3:
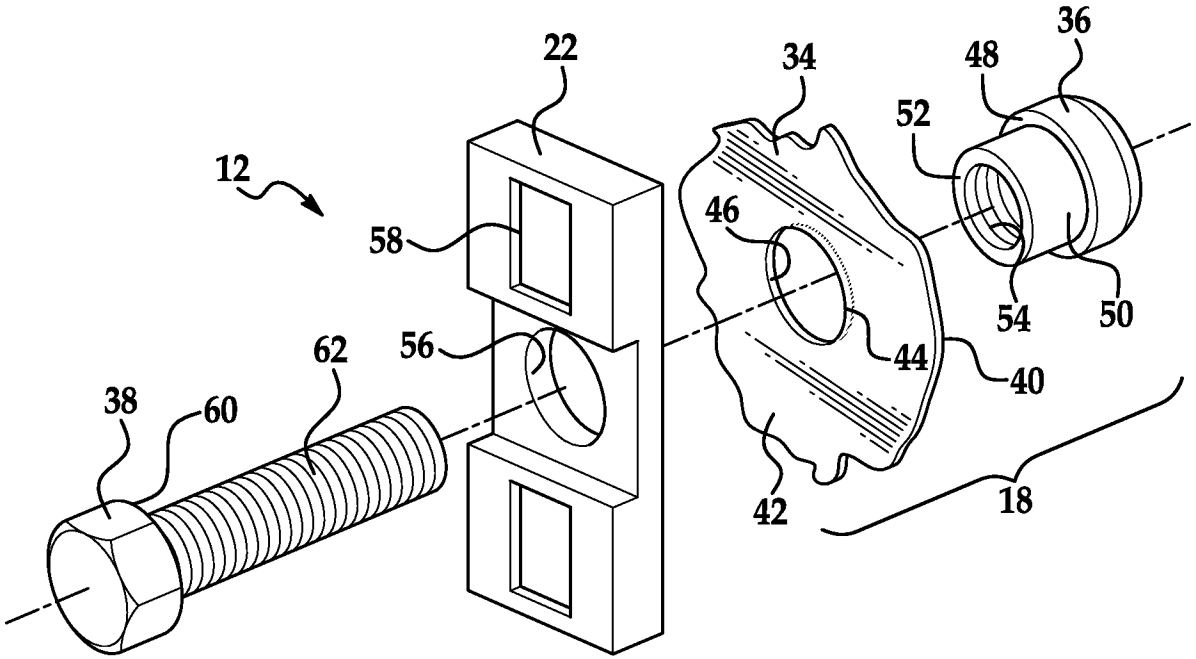
FIG. 3 is an exploded view of a portion of one embodiment of a window assembly.

FIG. 3 is an exploded view of a portion of an exemplary window assembly 12. In particular, a portion of the glass assembly 18 is shown, including glass sheet 34 and first fastener 36. Lift plate 22 and second fastener 38 are also shown. The glass assembly 18 may also include a coupling layer (not shown in FIG. 3) for arrangement between the first fastener 36 and the glass sheet 34, described in more detail below. The glass sheet 34 may be generally transparent automotive window glass of a desired size and thickness and may be tempered, tinted, or otherwise made suitable for vehicle-specific applications. The glass sheet 34 may be generally planar with a first side 40 and an opposite second side 42, where the first and second sides 40, 42 are generally parallel to each other through the thickness of the glass. However, the glass sheet 34 is not necessarily flat and may include curved (e.g., convex and/or concave) portions. The glass sheet 34 may also include one or more apertures 44 formed therethrough. An edge or boundary 46 of the aperture 44 connects the first and second sides 40, 42 of the glass sheet 34 through its thickness. In the illustrated embodiment, the aperture 44 is round and sized to accommodate first fastener 36, but the aperture 44 can be any suitable shape or size. The aperture 44 may be located at a portion of the glass sheet 34 that is hidden from view during use. The aperture 44 of FIG. 3 is formed entirely within the outer perimeter of the glass sheet 34, but could also be formed at the perimeter of the glass sheet in the form of a cut-out or notch, for example.

The first fastener 36 is part of the glass assembly 18 and is configured to accommodate attachment of the lift plate 22 to the glass assembly 18. Fastener 36 may include a shoulder 48 and a body portion 50 extending from the shoulder 48 to a free end 52. The shoulder 48 is sized so that it cannot pass through the aperture 44, and the body portion 50 is sized so that it fits within the aperture 44. In the illustrated embodiment, the shoulder 48 and body portion 50 are round, but each can be any suitable shape and do not have to be the same shape as the aperture 44. The fastener 36 may include a threaded portion 54 to engage the second fastener 38. The illustrated threaded portion 54 includes internal threads, but could alternatively include external threads for engaging fastener 38. In one embodiment, the threaded portion 54 includes internal threads that extend along the entire length of the first fastener 36. The fastener 36 may be constructed from any suitable material including metals, polymers (e.g., acetal, nylon, PVC, or other polymer), or composites. In one particular embodiment, the fastener 36 is made of steel. In another embodiment, the body portion 50 has a diameter in a range from about 12 mm to about 16 mm and fits within the aperture 44 with about 0.2 mm to about 0.3 mm clearance between the body portion 50 and the aperture edge 46. In some embodiments, the body portion may be omitted so that the first fastener 36 does not extend into or through the aperture 44.

The lift plate 22 is a component that couples the glass assembly 18 to the actuator mechanism. In this example, the lift plate 22 is attached to the glass assembly 18 by the second fastener 38 through a plate opening 56. The lift plate 22 may be generally flat and/or conform to the shape of the glass sheet 34, as shown, and can also include one or more slots, openings, or other features for attachment of the actuator mechanism. The illustrated embodiment includes a pair of slots 58 for this purpose, which is described in more detail below. Like the first fastener 36, the second fastener 38 includes a shoulder 60 and a body portion 62. In the example of FIG. 3, the body portion 60 includes external threads for engagement with the threaded portion 54 of the first fastener 36, and the shoulder 60 is sized so that it cannot pass through the plate opening 56. Of course, fasteners 36, 38 may be any type of fastener and are not limited to threaded fasteners. For example, they may include a snap-fit or be configured to be attached together by other means such as welding, adhesive, crimping, etc.

Figure 4:
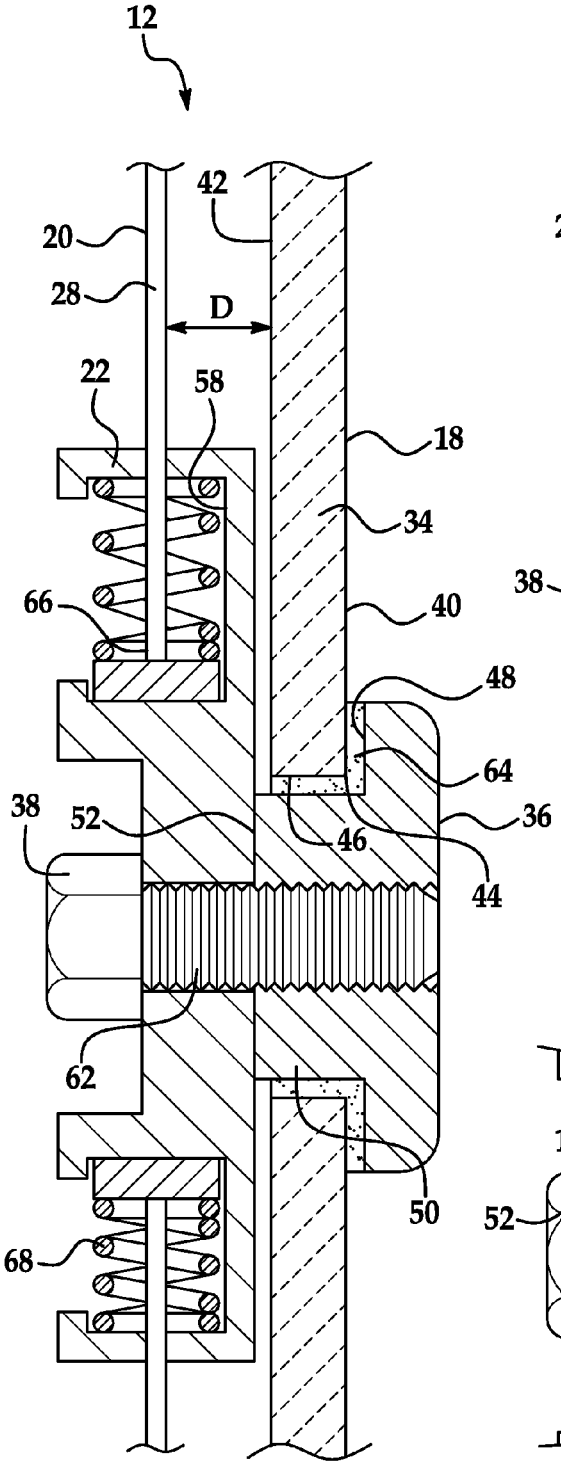
FIG. 4 is a cross-sectional view of a portion of the window assembly of FIG. 2, according to one embodiment.

FIG. 4 is a cross-sectional view of a portion of one embodiment of window assembly 12. In this particular embodiment, the cables 28 of the actuator mechanism 20 are attached at opposite ends of the lift plate 22, and the second fastener 38 attaches the lift plate 22 to the first fastener 36 of the glass assembly 18. As shown in FIG. 4, the glass assembly 18 may also include a coupling layer 64 between the first fastener 36 and the glass sheet 34. The coupling layer 64 is a layer of material that can secure a fastener to the glass sheet 34, either temporarily or permanently, independently from other fasteners. For example, the coupling layer 64 may be an adhesive layer that bonds the first fastener 36 to the glass sheet 34.

Alternatively, the coupling layer 64 may be a grommet, insert, or other component with an opening sized to receive the fastener 36 with a press fit to secure the fastener 36 with the glass sheet 34 until other window assembly components are attached. The coupling layer 64 may also serve as a buffer material that is more flexible than the glass sheet and/or fastener materials to help isolate a hard fastener material, such as a metal, from the more brittle glass material. At least a portion of the coupling layer 64 is located between the fastener 36 and the edge 46 of the aperture 44 and/or between the fastener 36 and the first side 40 of the glass sheet 34. In the illustrated embodiment, the coupling layer 64 is an adhesive layer that is located between the fastener 36 and the glass sheet 34 at both the edge 46 and the first side 40 of the glass. The adhesive layer may include any suitable adhesive. Some non-limiting examples include J-B Weld® Epoxy, Permatex® Ultra Grey® Rigid High-Torque RTV Silicone Gasket Maker, Permatex® Clear RTV Silicone Adhesive Sealant, and Scotch-Weld™ Two-Part Epoxy Adhesive (e.g., DP-420).

FIG. 4 shows the first fastener 36 coupled to the glass sheet 34 at the aperture 44 with the shoulder 48 at the first side 40 of the glass sheet 34. The fastener 36 may be adhesively or otherwise secured to the glass sheet, by the coupling layer 64, for example. Or it may be coupled to the glass sheet 34 by press fit or other means. The fastener 36 is coupled to the glass sheet 34 at the first side 40 of the glass sheet 34 so that end 52 is accessible from the second side 42 of the glass sheet 34, to receive the second fastener 38, for example. The body portion 50 of the fastener 36 extends at least partially through the aperture 44, and in this case extends entirely through the aperture 44 beyond the plane of the second side 42 of the glass sheet 34 to end 52. The lift plate 22 is attached at the second side 42 of the glass sheet 34 via the second fastener 38, and the body portion 62 of the second fastener also extends through the aperture 44 in this example. In a different embodiment, the coupling layer 64 is omitted. For instance, the first fastener 36 may be constructed from a flexible material such as a polymer, and the body portion 50 of the first fastener 36 could have a press fit with the aperture 44 to couple it to the glass sheet 34. Or end 52 could be enlarged compared to the body portion 50 and sufficiently flexible to be pressed through the aperture 44 to secure the first fastener 36 at the aperture 44.

In the embodiment of FIG. 4, the lift plate 22 is attached to the cables 28 at slots 58, and ends 66 of the cables 28 are movable within the slots 58 against the bias of springs 68, which can provide some give and/or damping during movement of window assembly components. Springs or similar components are optional and may be located elsewhere along cables 28 and away from the lift plate 22. In one embodiment, the slots are horizontally spaced from each other along the lift plate 22 with one on each side of the plate opening so that the top and bottom cables are offset from each other. This is only one example of a window assembly 12 that could include additional features or have certain elements omitted. For example, the lift plate 22 may be a washer or similar structure attached to the end 66 of cable 28 to accommodate the second fastener 38, or the lift plate 22 could include an integral fastener for engaging the first fastener 36 where it extends through the aperture 44 from the opposite side of the glass sheet 34.

In operation, when the actuator mechanism 20 moves in response to a user request, a load is applied at the aperture 44 in a direction generally parallel with the plane of the glass sheet 34 (up or down in FIG. 4) and acts to move the glass assembly 18. At least a portion of the load is applied at the edge 46 of the aperture 44, and the coupling layer 64 bears at least some of the load. While some conventional arrangements support the glass sheet 34 along its bottom edge, the presently disclosed configurations do not require support along the bottom edge of the glass sheet, though it may optionally be provided. This can reduce or eliminate the need for some amount of packaging space within the vehicle door or panel that would be required by bottom edge supports. In addition, it will be appreciated that window assemblies made in accordance with these teachings can be constructed with a relatively slim profile to save even more space within doors or panels. In one embodiment, where the actuator mechanism includes a cable 28 attached to the lift plate 22, the cable 22 is spaced or offset a distance D from the glass sheet 34, and the offset distance is about 5 mm or less from the glass sheet 34. The offset D may be in a range from about 2 mm to about 5 mm. This can reduce torsional forces acting on the glass assembly compared to some traditional cable-based window assemblies that can have cable offsets up to 2 to 3 times larger. Reduced torsional forces can help reduce noise, increase system reliability, etc. Of course, the offset distance need not be 5 mm or less to realize other advantages of the disclosed window assemblies.

Another feature of this and some other embodiments of window assembly 12 is that the glass assembly 18 can be coupled with the actuator mechanism 20 with substantially no clamp load at the coupling location. This is unconventional, as some traditional arrangements seek to grip or pinch the glass between components in order to allow an actuator to move it. In the illustrated embodiment, where the end 52 of fastener 36 is proud of the surface of the glass sheet 34, the second fastener 38 clamps the lift plate 22 directly to the first fastener 36 with clearance between the plate 22 and the glass sheet 34 and no clamp load is applied to the glass sheet 34 at or near the aperture 44. This can offer the additional benefit of providing a coupling between the actuator mechanism 20 and the glass assembly 18 that can have an extra degree of freedom. In other words, the components can be configured to allow the lift plate 22 to rotate about a central axis of the first fastener 36, the second fastener 38, the aperture 44, and/or the plate opening 56. For example, the threaded portion 54 of the first fastener 36 may extend from end 52 only partially through the length of the fastener 36 so that the second fastener 38 stops short of clamping the lift plate 22 to the first fastener 36 when fully tightened, thereby allowing the lift plate 22 to freely rotate about the second fastener 38. This additional degree of freedom can allow the direction of the load applied to the glass assembly 18 by the actuator mechanism 20 to change as necessary during operation, which can be useful in applications where the load distribution along the width of the glass sheet changes as it is moved. This can help prevent noise and/or binding during operation. In one embodiment, a bearing such as a low friction washer (not shown) maybe be provided between the lift plate 22 and the glass sheet 34 at the aperture 44.

Figure 5:
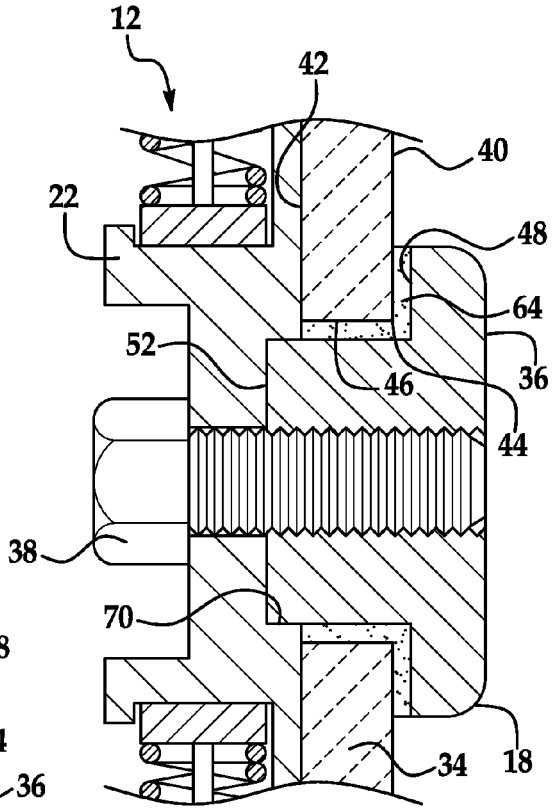
FIG. 5 is a cross-sectional view of the same portion of the window assembly illustrated in FIG. 4, according to another embodiment.

FIG. 5 shows a portion of another embodiment of the window assembly 12 in which the lift plate 22 contacts the glass sheet 34. In this particular example, the end 52 of the first fastener 36 is located in a recessed area 70 of the lift plate 22 to accommodate the same first fastener 36 shown in FIG. 4. In other examples, the end 52 of the first fastener 36 may be flush with the second side 42 of the glass sheet 34, or the first fastener 36 may extend only partially through the aperture 44. The length of the first fastener 36 and/or the depth of the recessed area 70 can be selected to determine the spacing between the lift plate 22 and glass sheet 34. In the configuration of FIG. 5, some clamp load may be applied to the glass sheet 34 when the fasteners 36, 38 are tightened together. This load can be distributed at the second side 42 of the glass sheet 34 at its interface with the lift plate, and at the first side 40 of the glass sheet 34 along the shoulder 48 of the first fastener 36. The coupling layer 64 can provide some flexibility at the first side 40 of the glass sheet 34 to help reduce the likelihood of cracking the glass sheet during assembly. Also, with the aperture edge 46 available to accommodate some of the load applied to the glass assembly 18 during operation, the clamp load between the lift plate 22 and the glass sheet 34 can be reduced compared to other configurations that rely on gripping or pinching the glass, thus further reducing the likelihood of glass cracking.

Figure 6:
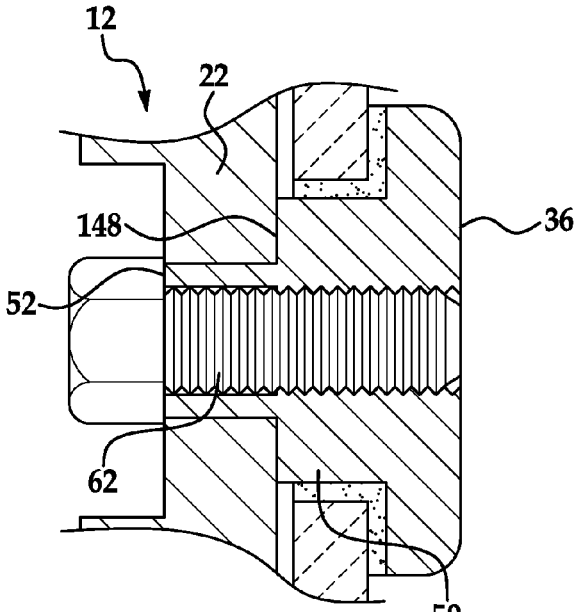
FIG. 6 is a cross-sectional view of the same portion of the window assembly illustrated in FIG. 4, according to another embodiment.

FIG. 6 shows a portion of another embodiment of the window assembly 12 in which the body portion 50 of the first fastener 36 includes a second shoulder 148. In this example, the body portion 50 extends at least partially through the lift plate 22 with the second shoulder 148 in contact with the lift plate. The segment of the body portion 50 between the second shoulder 148 and the end 52 of the first fastener 36 can provide a more consistent surface around which the lift plate can pivot during operation.

An exemplary method of making a window assembly includes the steps of coupling the first fastener at one side of the glass sheet at the aperture and attaching the lift plate at the opposite side of the glass sheet using the second fastener. A portion of at least one of the fasteners extends through the aperture during assembly and in the finished window assembly. The lift plate may be attached to the glass assembly either before or after being attached to the actuator mechanism. Where the coupling layer is included, it may be applied to the first fastener and/or the glass sheet prior to coupling the first fastener at the aperture. For example, adhesive may be applied to one or both of the first fastener or glass sheet prior to assembly to form the coupling layer between the two components when assembled.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A glass assembly for use in a vehicle, comprising:

a glass sheet having an aperture formed there through;

a fastener coupled to the glass sheet at the aperture, the fastener having a shoulder at one side of the glass sheet and a body portion extending from the shoulder and at least partially through the aperture to an end that is accessible from an opposite side of the glass sheet, the fastener being adapted for attachment of a lift plate to the glass assembly at the opposite side of the glass sheet, wherein the fastener extends sufficiently through the aperture to make physical contact with the lift plate when attached to the class assembly;

a coupling layer between the fastener and the glass sheet that independently secures the fastener to the glass sheet and no clamp load is applied to the glass sheet by the fastener.

2. A glass assembly as defined in claim 1, wherein the coupling layer is an adhesive layer.

3. A glass assembly as defined in claim 2, wherein the aperture includes an edge that connects the opposite sides of the glass sheet through the thickness of the glass sheet, and at least a portion of the adhesive layer is located between the fastener and the edge of the aperture.

4. A glass assembly as defined in claim 1, wherein the fastener includes internal threads for attachment of the lift plate to the glass assembly using an externally threaded fastener.

5. A window assembly including the glass assembly of claim 1, the window assembly further comprising:

the lift plate attached to the glass assembly at said opposite side of the glass sheet and contacting the fastener; and an actuator mechanism attached to the lift plate for moving the glass assembly such that a load is applied at an edge of the aperture when the actuator mechanism moves the glass assembly and the coupling layer bears at least a portion of the load, wherein the edge of the aperture connects the opposite sides of the glass sheet through the thickness of the glass sheet.

6. A window assembly as defined in claim 5, wherein the lift plate is attached to the glass assembly with no clamp load applied to the glass sheet through the thickness of the glass sheet.

7. A window assembly as defined in claim 5, wherein the lift plate is clamped to the fastener with clearance between the lift plate and the glass sheet.

8. A window assembly as defined in claim 5, wherein the lift plate is free to rotate at least partly about a central axis of the fastener during operation of the actuator mechanism.

9. A window assembly for use in a vehicle, comprising:

a glass assembly having a glass sheet with an aperture formed therethrough and a first fastener bonded to one side of the glass sheet at the aperture, the aperture comprising an edge;

a lift plate located at an opposite side of the glass sheet and attached to the first fastener with a second fastener such that no clamp load is applied to the class sheet through the thickness of the class sheet by the first or second fasteners, wherein a portion of at least one of the first or second fasteners extends through the aperture; and an actuator mechanism attached to the lift plate for moving the glass assembly by applying a load to the lift plate in a direction of movement generally parallel with the plane of the glass sheet, wherein, when the actuator mechanism moves the glass assembly, the first or second fastener applies the load to the glass sheet at the edge of the aperture in the direction of movement, and wherein a bottom edge of the glass sheet is unsupported during glass assembly movement.

10. A window assembly as defined in claim 9, wherein the lift plate is free to rotate at least partly about at least one of the first or second fasteners.

11. A window assembly as defined in claim 9, wherein the first fastener includes a shoulder at said one side of the glass sheet and a body portion extending at least partially through the aperture.

12. A window assembly as defined in claim 9, wherein the first fastener extends at least partially through the lift plate and includes a shoulder in contact with the lift plate.

13. A window assembly as defined in claim 9, further comprising an adhesive layer, wherein the adhesive layer bonds the first fastener to the glass sheet and extends at least partially through the aperture.

14. A window assembly as defined in claim 9, wherein the actuator mechanism includes one or more cables attached to the lift plate such that at least one cable is offset from the glass sheet by 5 mm or less.

15. A window assembly as defined in claim 9, wherein the window assembly includes a plurality of lift plates located at a plurality of corresponding apertures located within a periphery of the glass sheet.

16. A window assembly as defined in claim 9, wherein the lift plate is free to rotate at least partly about a central axis of the fasteners during operation of the actuator mechanism.

17. A window assembly as defined in claim 9, wherein the first fastener includes a shoulder at said one side of the glass sheet and a body portion extending through the aperture and beyond the opposite side of the glass sheet to an end that is proud of the opposite side of the glass sheet, the window assembly further comprising an adhesive layer that bonds the first fastener to the glass sheet, the adhesive layer extending between the first fastener and the glass sheet and at least partially through the aperture between the body of the first fastener and the edge of the aperture; and wherein the lift plate is free to rotate at least partly about a central axis of the fasteners during operation of the actuator mechanism.

18. A window assembly, comprising:

a glass sheet having one or more apertures formed therethrough, each aperture having an edge that connects opposite sides of the glass sheet through the thickness of the glass sheet;

a lift plate coupled with the glass sheet via a fastener that extends at least partially through one of the apertures;

an actuator configured to move the glass sheet by applying a load at the edge of at least one of the one or more apertures in a direction generally parallel with the plane of the glass sheet, wherein said load is applied via the fastener, and wherein the lift plate is coupled with the glass sheet such that the lift plate is free to rotate at least partly about a central axis of the fastener during actuator operation and no clamp load is applied to the glass sheet by the fastener.

19. A window assembly as defined in claim 18, wherein the fastener couples the lift plate to the glass sheet with no clamp load applied to the glass sheet through the thickness of the glass sheet.

20. A window assembly as defined in claim 18, wherein a bottom edge of the glass sheet is unsupported during movement of the glass sheet.

* * * * *